US006557389B1

(12) United States Patent
Listak et al.

(10) Patent No.: US 6,557,389 B1
(45) Date of Patent: May 6, 2003

(54) MACHINE FOR CORRUGATING METAL FOILS

(75) Inventors: Ray R. Listak, Chula Vista, CA (US); John D. Beyer, Escondido, CA (US); John E. Meaney, Bonita, CA (US)

(73) Assignee: Rohr, Inc., Chula Vista, CA (US)

( * ) Notice: Subject to any disclaimer, the term of this patent is extended or adjusted under 35 U.S.C. 154(b) by 16 days.

(21) Appl. No.: 09/970,571

(22) Filed: Oct. 4, 2001

(51) Int. Cl.[7] ..... B21J 13/10; B21D 13/02

(52) U.S. Cl. ..... 72/420; 72/385; 72/414; 72/417; 72/441

(58) Field of Search ..... 72/187, 188, 190, 72/192, 196, 214, 220, 379.2, 379.6, 385, 414, 417, 420, 441, 446, 447

(56) References Cited

U.S. PATENT DOCUMENTS

| | | | | | |
|---|---|---|---|---|---|
| 3,673,846 | A | | 7/1972 | Levington et al. | 72/326 |
| 3,971,243 | A | | 7/1976 | Jones | 72/385 |
| 4,450,706 | A | * | 5/1984 | Engelmohr | 72/385 |
| 4,471,013 | A | * | 9/1984 | Welzen | 428/116 |
| 4,608,845 | A | | 9/1986 | Campbell | 72/44 |
| 4,840,054 | A | | 6/1989 | Sjögren | 72/382 |
| 4,989,440 | A | * | 2/1991 | Sjogren | 72/385 |
| 5,689,989 | A | | 11/1997 | Süess et al. | 72/187 |
| 6,339,947 | B1 | * | 1/2002 | Bodnar | 72/190 |

FOREIGN PATENT DOCUMENTS

| | | | | |
|---|---|---|---|---|
| JP | 61-147926 | * | 7/1986 | 72/385 |

* cited by examiner

*Primary Examiner*—Ed Tolan
(74) *Attorney, Agent, or Firm*—Baker Botts L.L.P.

(57) ABSTRACT

A machine for corrugating a metal foil strip includes a form gear having identical cavities along its perimeter that is driven intermittently by an electronically controlled rotary servomotor to index successive cavities to a forming station. During each dwell of the form gear, a form tooth of a punch unit at the forming station is driven by an electronically-controlled linear servomotor into the cavity to at least partly form a corrugation in the strip. During each operating stroke of the punch unit, a hold finger clamps the immediately outgoing node of the corrugation that just left the forming station against the immediately outgoing tooth of the form gear, thus preventing any part of the outgoing corrugation from being pulled back into the cavity and ensuring that the next corrugation is formed solely from a segment drawn in from the incoming foil.

22 Claims, 9 Drawing Sheets

56
40
42
48
52
50
54
52s
76
58
44
28
30
34
46
22
32
24
21
26
20

MACHINE FOR CORRUGATING METAL FOILS

BACKGROUND OF THE INVENTION

1. Field of the Invention

The present invention relates generally to the field of forming metal foils and, more particularly, to corrugating metal foil strips for use in fabricating a metal honeycomb core material for lightweight honeycomb sandwich panels.

2. Background Information

Honeycomb sandwich panels are in widespread use in, for example, aerostructures. Producing the core material for honeycomb sandwich panels having a honeycomb core of a metal, such as aluminum or titanium, requires corrugating thin foil strip material for assembly of the honeycomb core. Two basic types of machines have previously been used for corrugating metal foil strips.

In one type of machine, foil strip material passes between a pair of rotating, meshing forms gears and in so doing is corrugated as the teeth of one gear progressively push segments of the foil into the cavities between the teeth of the other gear. One significant problem with gear/gear machines is maintaining close tolerances, especially the pitch of the nodes where adjacent corrugated strips are joined to each other to form the honeycomb material. The corrugations are subject to variations in their shapes and dimensions due to some elastic rebound of the corrugations after they are formed and variations in the pressure acting on the strip material as it is progressively pressed into a cavity between adjacent teeth of one form gear by a tooth of the other form gear. Because both form gears are rotating at the time of forming a corrugation, the tooth of one form gear rocks about its tip relative to the cavity of the other form gear that receives it. The rocking of the teeth also imposes limitation on the shapes and depths of the corrugations. An advantage of gear/gear machines is that the gears feed the incoming foil stock by drawing it into the meshing portion and pushing the corrugated strip material out as the gears rotate.

Strips of metal foil for making honeycomb core material have also previously been corrugated by sequentially pressing segments of the strip into the cavity of a form die by a reciprocating punch. Commonly, the punch has several teeth and the die several cavities, the teeth and cavities being successively larger and deeper in the feed direction so that each corrugation is formed progressively in stages. Generally, a well designed "punch/die" corrugating machine is capable of greater precision than a gear/gear machine because the working of the strip material is unidirectional and the strip is stationary during working. A punch/die machine is, however, more complicated than a gear/gear machine, inasmuch as the strip has to be fed by a hitch feed mechanism, which pushes the stock one pitch distance into the punch/die forming part of the machine and dwells while the punch moves in the working stroke. Punch/die machines also rely on rebounding of the strip from the die to clear the nodes from the die so that the strip can be indexed to bring a new segment between the punch and die. Operating speeds are limited due to the relatively large masses of the tools and the need to index the foil strip after each operating cycle of the punch. For any given machine, there is no way of controlling the punch force, which would be desirable to accommodate foils of different materials and thicknesses. Generally, the machines are designed to handle the least ductile and thickest materials being corrugated. More ductile and thinner materials are, therefore, subjected to excessive forces. The forming tools wear rapidly and are subject to fatigue fracture. Large amounts of lubricant are required on the forming surfaces to minimize friction between the foil stock and the forming tools.

In view of the disadvantages of gear/gear and punch/die corrugating machines, there is a need for a machine for corrugating a metal foil strip with greater precision than can be readily attainable with gear/gear machines and at greater speeds and with less complicated machine elements than are ordinarily found in previously known punch/die machines. There is also a need for a corrugating machine in which the operating parameters can be readily controlled, preferably on the fly. It is also desired to have a corrugating machine that can form corrugations of more complex shapes and/or with nodes of greater depth than those that can be formed with previously known machines.

SUMMARY OF THE INVENTION

The foregoing needs are fulfilled, in accordance with the present invention, by a machine for corrugating a metal foil strip that includes a form gear having equally spaced-apart identical teeth defining a multiplicity of identical cavities along the circumference of the form gear, a rotary drive rotating the form gear intermittently to index successive cavities to a forming station along the perimeter of the form gear where a corrugation is at least partly formed in a cavity then at the forming station while the rotary drive dwells, and a punch unit located at the forming station for forming corrugations in the strip one by one. The punch unit has a form tooth receivable seriatim in the cavities of the form gear and adapted thereby to at least partly form corrugations in the foil strip, and a reciprocating linear actuator driving the form tooth radially of the form gear in a succession of forming cycles. Each of the forming cycles includes a forming stroke in which the form tooth moves into a cavity then at the forming station, a return stroke in which the form tooth moves out of the cavity then at the forming station, and a dwell period in which the form tooth dwells while the form gear indexes.

One very significant advantage of a machine according to the present invention is that the form gear is stationary as each corrugation is formed by a unidirectional forming stroke of the form tooth. Accordingly, the corrugations may be formed with greater precision than is generally attainable with a gear/gear machine. The form tooth and the cavities of the form gear may be closely complementary in shape, because there is no rocking motion of each tooth of one form gear relative to the cavity of the other form gear. A machine according to the present invention is of a construction that is simpler than that of a punch/die machine, inasmuch as the form gear transports the outgoing corrugated strip away from the forming station as it successively indexes new segments of foil to the forming station. Accordingly, a strip transport mechanism separate from the punch/die unit or mechanisms for moving the punches in the direction of the path of the strip to index corrugated sections of the strip away from the forming station and transport another section from the supply to the forming station are not required. The form tooth may be kept small and light in weight and can thus be relatively rapidly accelerated and decelerated during each forming cycle, thereby permitting a higher operating speed than is conventionally available in known gang-type punch/die machines.

In preferred embodiments, the punch unit further includes a hold finger that is engageable with an outgoing node of a corrugation of the strip and holds the outgoing node against the tip of the tooth of the form gear on the outgoing side of the cavity then at the forming station during a substantial portion of the duration of each forming cycle of the punch. The hold finger feature prevents the outgoing corrugation from being pulled back partly into the cavity then at the forming station and ensures that the next corrugation is formed solely from a segment from the incoming foil supply. The resulting precise displacement into the cavity of a segment drawn solely from the incoming strip and the elimination of any pull-back of part of the outgoing node contribute to more consistent formation of the corrugations.

A machine according to the invention, preferably, includes an electronically-controlled linear servomotor driving the punch and an electronically-controlled rotary servomotor driving the form gear. Servo drives permit on-the-fly control of the operating speed, the force applied to the strip by the form tooth, and the timing of each portion of the operating cycle. The machine can be controlled by relatively simple computer programs. It is desirable to place the drives in a master-slave relationship.

Linear servomotors have driveshafts that are in lateral clearance from the driving coils. Accordingly, the drive shaft does not provide precise axial movement of the tool that it drives. In order to move the form tooth precisely into the cavity of the form gear, the punch unit includes a fixed tool guide having a guideway receiving a portion of the form tooth for guided axial movement. A tool support is affixed to the output shaft of the linear actuator, and the form tooth is carried by the tool support for universal swiveling motion relative to the tool support. The swivel connection allows the form tooth to be guided by the tool guide into the cavity without binding, even though the drive shaft inherently displaces slightly from axial alignment with the nominal center axis of the linear servomotor.

It is desirable to include a foil exit guide shoe extending along a segment of the form gear immediately downstream of the forming station and having a guide surface in close clearance with outer nodes of an outgoing corrugated portion of the foil strip so as to retain the outgoing corrugated portion of the foil strip in a multiplicity of cavities of the form gear. Such an exit guide holds several nodes of the corrugated foil strip immediately downstream from the forming station in place on the form gear for reliable transport of the corrugated part of the strip from the forming station and of the supply strip to the forming station.

The present invention also includes embodiments in which each corrugation is formed in two (or more) stages. In a two-stage machine, for example, the form tooth of a first-stage punch unit is shaped to only partially form the corrugations, and the machine has a second-stage punch unit located at a second forming station along the circumference of the form gear that is spaced apart from the first-stage forming station. The second-stage punch unit has a form tooth that is receivable seriatim in the cavities of the form gear and shaped to fully form the corrugations in the foil strip and a second reciprocating linear actuator driving the second form tooth radially of the form gear intermittently in a succession of forming cycles, each of which includes a forming stroke in which the second form tooth moves into a cavity then at the second forming station and a return stroke in which the second form tooth moves out of the cavity then at the second forming station, each forming cycle of the second form tooth being concurrent with the forming cycle of the punch unit.

The second-stage punch unit, preferably, includes a pair of hold fingers. One hold finger is arranged to engage an incoming node of a partly formed corrugation of the strip against the tip of the tooth of the form gear on the incoming side of the cavity then at the second forming station during a substantial portion of the duration of each forming cycle of the second-stage form tooth. The other hold finger is arranged to engage an outgoing node of a corrugation of the strip against the tip of the tooth of the form gear on the outgoing side of the cavity then at the second forming station during a substantial portion of the duration of each forming cycle of the second form tooth. Holding the nodes against the teeth on either side of the cavity then at the forming station ensures that the second-stage forming of each corrugation involves evenly pressing the node being formed without any pull forward of a partially formed, incoming corrugation or pull back of a fully-formed, outgoing corrugation.

The foregoing description has outlined rather broadly some features and advantages of the present invention. The detailed description of embodiments of the invention that follows will enable the present invention to be better understood and the present contribution to the art to be more fully appreciated. Those skilled in the art will recognize that the embodiments may be readily utilized as a basis for modifying or designing other structures for carrying out the purposes of the present invention. All such structures are intended to be included within the spirit and scope of the invention as set forth in the appended claims.

DETAILED DESCRIPTION OF THE INVENTION

Figure 1:
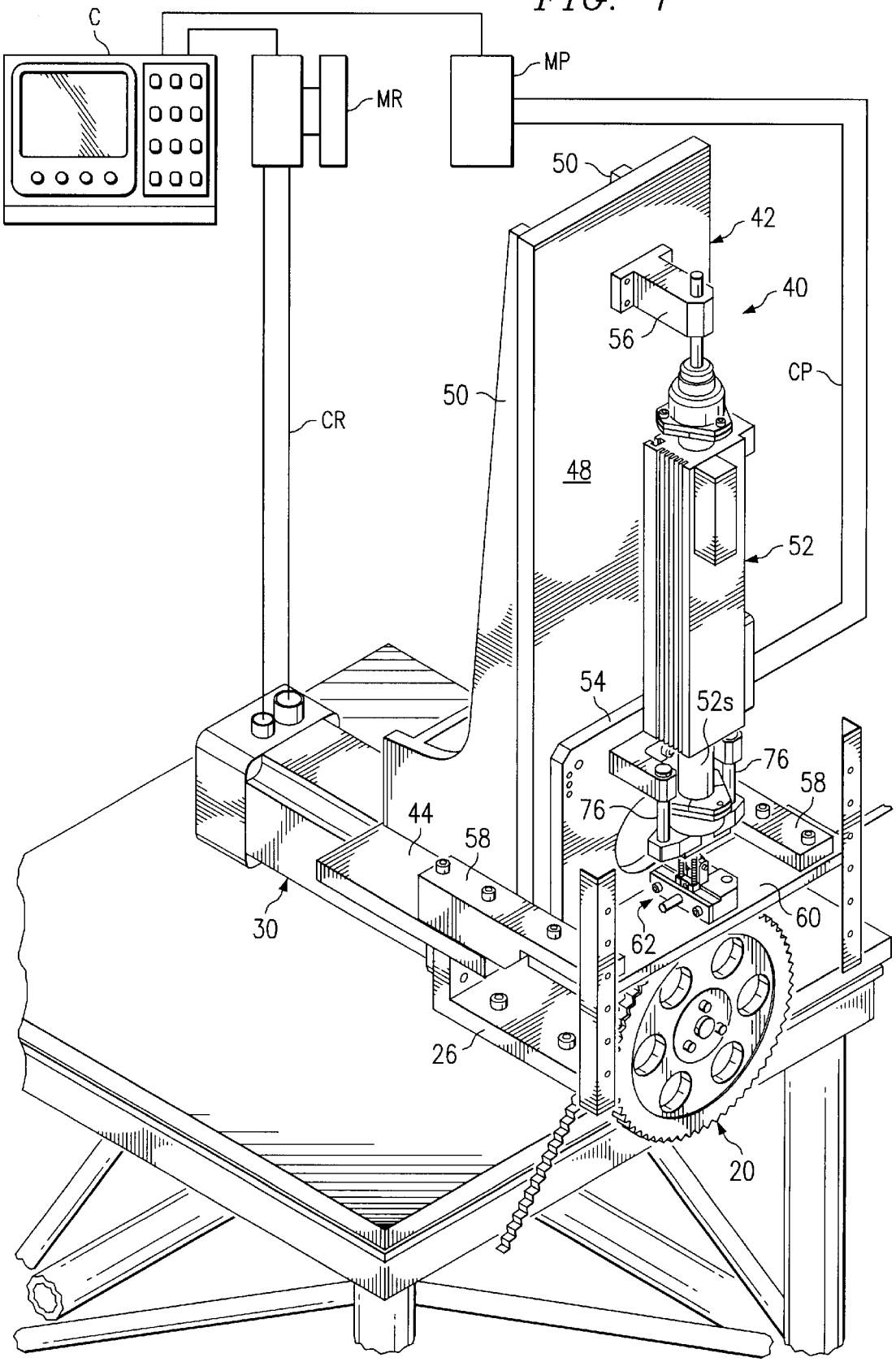
FIG. 1 is a generally schematic front three-quarter perspective view of a first embodiment, the view being taken from a viewpoint above and to the left.
Figure 2:
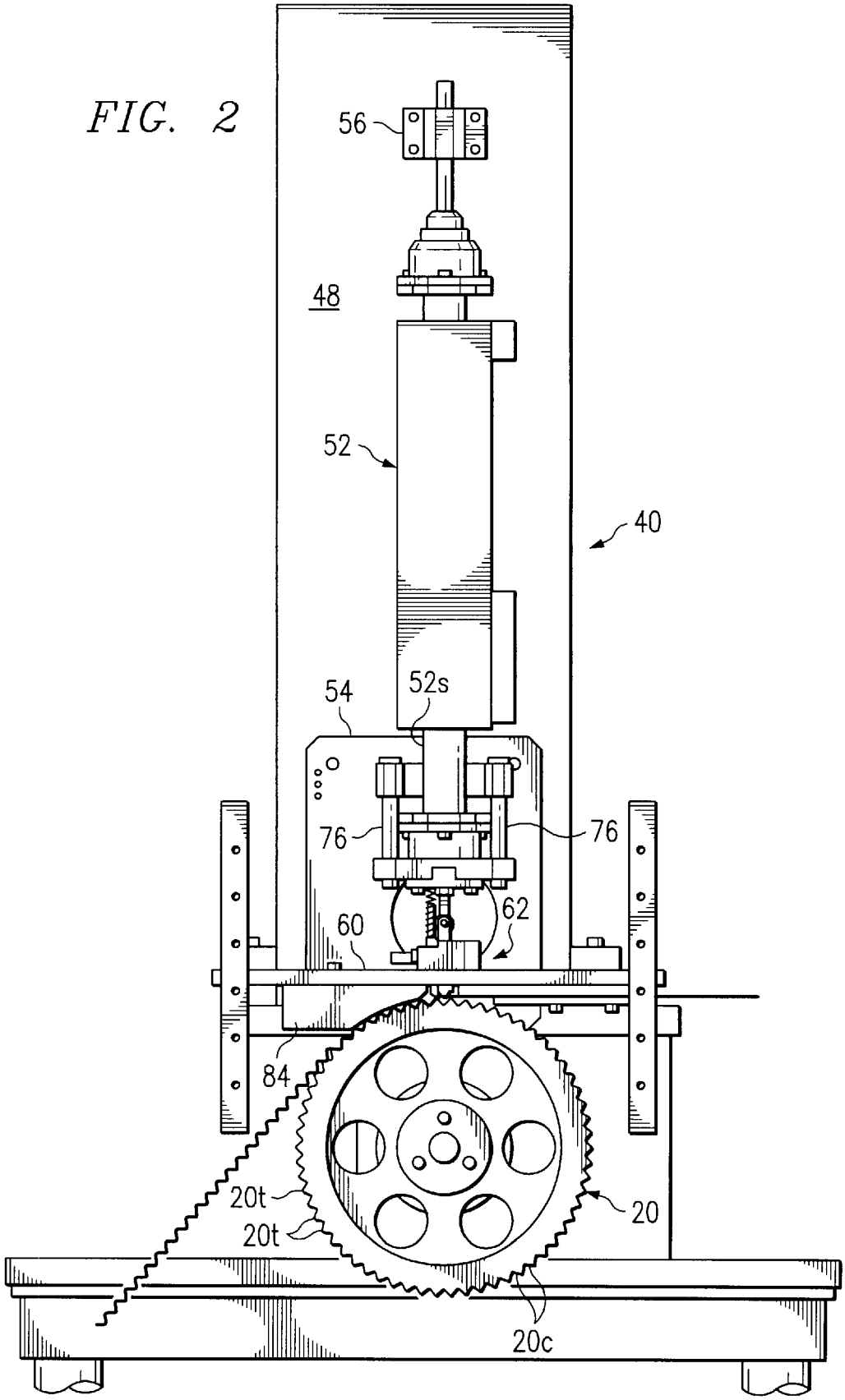
FIG. 2 is a generally schematic front elevational view of the first embodiment.
Figure 3:
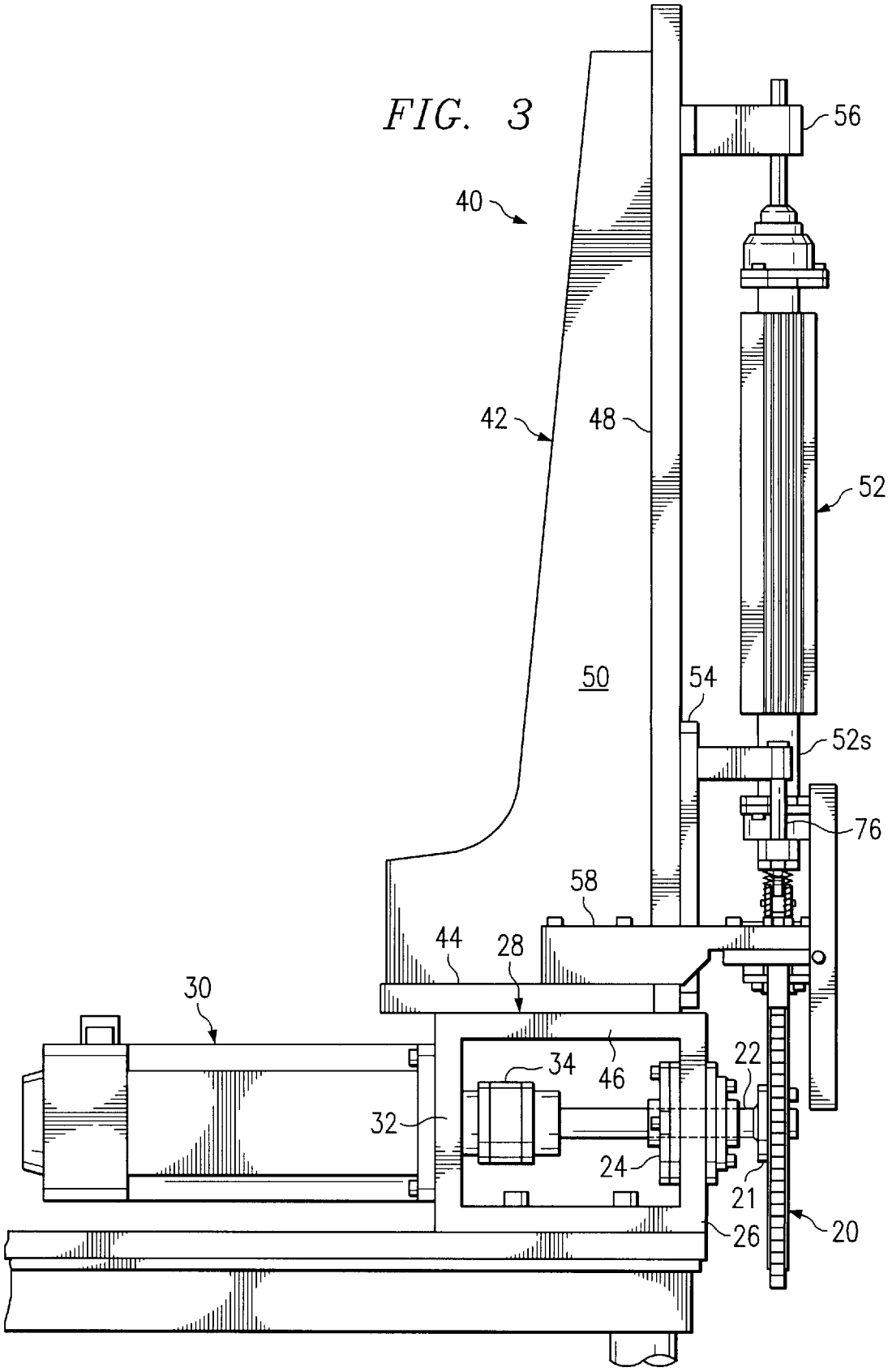
FIG. 3 is generally schematic left side elevational view of the first embodiment.

Referring to FIGS. 1 to 3, the machine includes a form gear 20, which is removably attached to a hub 21 on a shaft 22 that is mounted for rotation in a bearing 24 (see FIG. 3) in a front vertical plate 26 of a box-like base frame 28. The form gear 20 is driven in rotation by an electronically-controlled rotary servomotor 30, which is mounted on a back vertical plate 32 of the base frame 28 and is coupled to the shaft 22 by a coupling 34. The form gear 20 has on its perimeter surface a multitude of equally spaced apart, identically-shaped cavities 20*c* formed by equally spaced-apart, identically shaped teeth 20*t*.

A punch unit 40 supported above the form gear 20 includes a frame 42 having a base plate 44 that is fastened (e.g., by bolting or welding) to a top plate 46 of the frame 28, a vertical mounting plate 48 and a pair of side stiffener plates 50, the plates 44, 48 and 50 being joined such as by welding to make the frame 42 rigid. An electronically-controlled linear servomotor 52 is mounted by brackets 54 and 56 on the vertical mounting plate 48.

Figure 4:
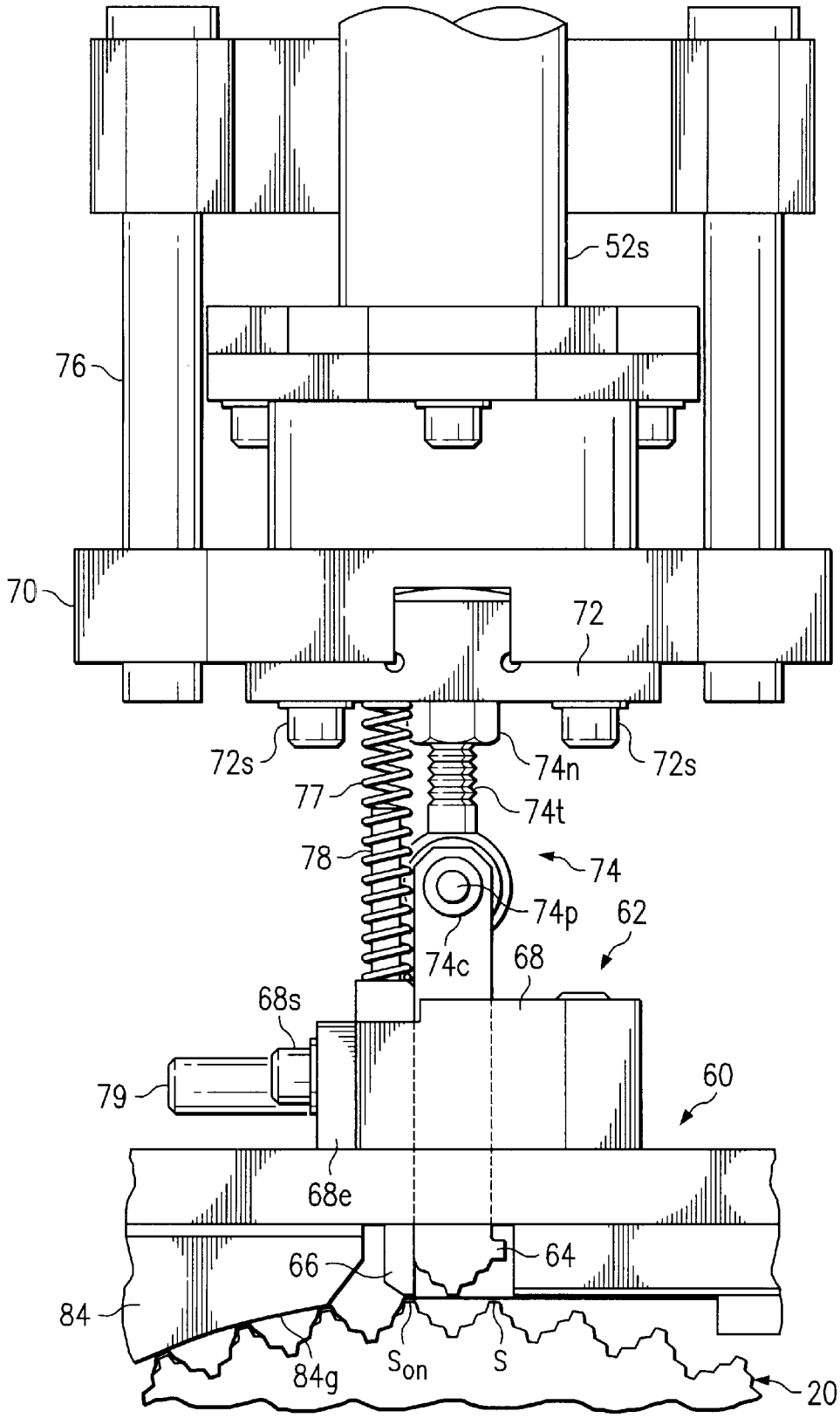
FIG. 4 is a detail front elevational view of the working elements of the punch and a portion of the form gear of the first embodiment.
Figure 5:
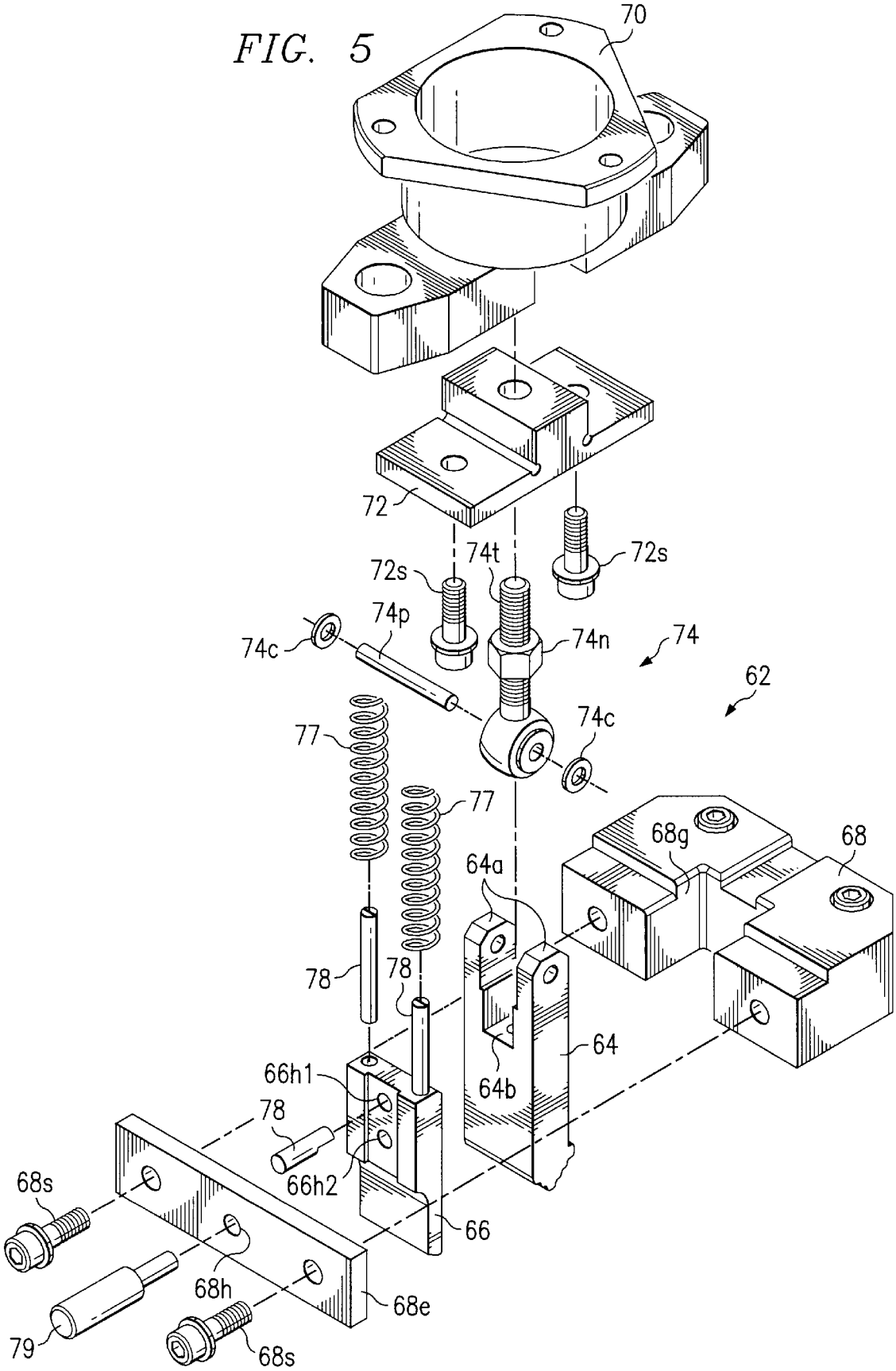
FIG. 5 is a generally schematic detail exploded pictorial view of working elements of the punch of the first embodiment.

A pair of cantilevered, horizontal arms 58 bolted to the base plate 44 support a guide mounting plate 60 for a fixed guide assembly 62 (see FIGS. 4 and 5). The guide assembly 62 guides a reciprocating form tooth 64 that is coupled to and driven by the linear servomotor 52 and also guides a hold finger 66 that is actuated by the linear servomotor in the manner described below. A U-shaped guide block 68 is affixed to the mounting plate 60. A slot between the legs of the guide block is closed by a guide end plate 68*e* that is fastened to the guide block 68 by screws 68s so as to form a guideway 68*g* for the form tooth 64 and the hold finger 66, which are received in the guideway with a sliding clearance that allows the form tooth and the hold finger to reciprocate toward and away from the form gear 20.

The form tooth 64 is coupled to the output shaft 52*s* of the linear servomotor 52 by a fitting 70, an adapter block 72, and a universal swivel connector 74. The fitting 70 is guided in its vertical motion by a pair of guide rods 76 that depend from arms 54*a* of the bracket 54 (see FIGS. 1 to 3) so that the shaft 52*s* and the fitting do not rotate about the axis of the shaft 52*s*. The adapter 72 is affixed to the fitting 70 by screws 72*s*. The threaded shank 74*t* of the swivel connector 74 threads (for vertical adjustment) into the adapter 74 and is locked in a set position by a nut 74*n*. The form tooth 64 is coupled to the swivel connector 74 by a pin 74*p* and C-rings 74*c*.

Figure 7A:
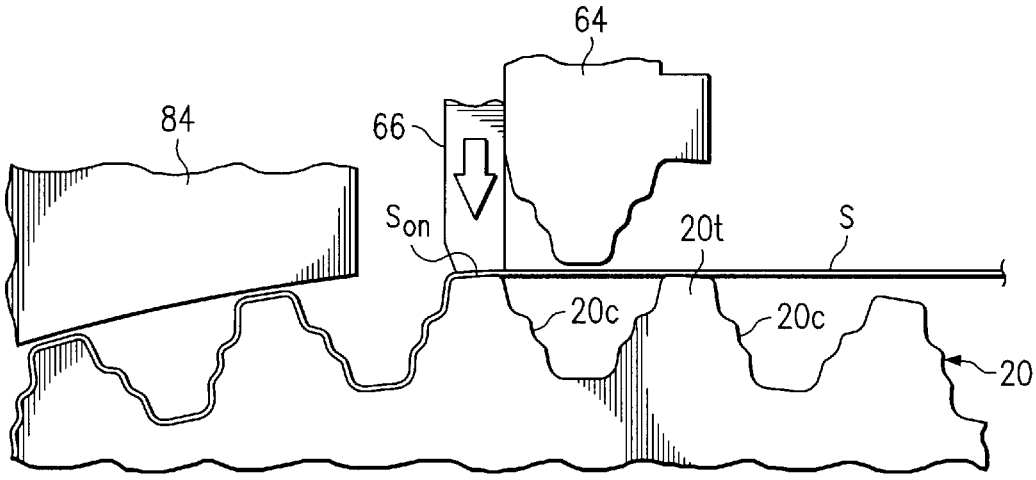
FIGS. 7A. 7B and 7C are generally schematic detail views showing three points in the operation of the first embodiment.
Figure 7B:
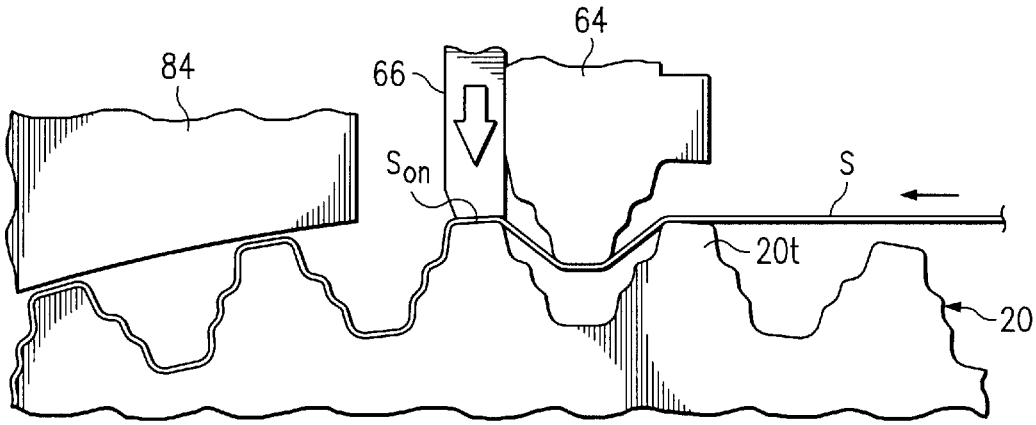
Figure 7C:
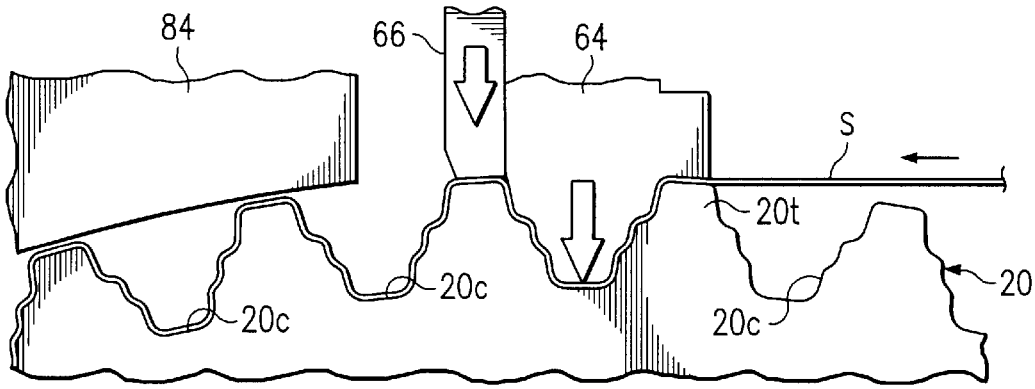

The hold finger 66 is linked to the form tooth 64 near the top of the stroke of the form tooth by a coupling pin 78, which passes through a hole 66*h*1 in the hold finger. The tip portion of the coupling pin 78 projects into a slot between arms 64*a* of the form tooth 64. When the shaft of the linear servomotor 52 is near the top of its stroke, the pin 78 engages the base surface 64*b* of the slot between the arms 64*a*, thus lifting the hold finger 66 to a position slightly above upper surface of the then outgoing node $O_{no}$ of a foil strip S (FIGS. 4 and 7A to 7C) being corrugated. Just after the start of the down stroke of the form tooth, the hold finger engages the outgoing node (see FIG. 7A). A pair of compression springs 77, which are kept axially straight by guide rods 78 affixed to the hold finger 66, apply a force to the outgoing node on $O_{no}$ that clamps it against the outgoing tooth 20*t* of the form gear 20 immediately adjacent the cavity 20*c* that is then at the forming station. The hold finger 66 prevents any part of the corrugation that was formed during the previous cycle of the punch unit 40 from being pulled back into the cavity 20*c* then at the forming station (see FIGS. 7B and 7C). Accordingly each corrugation is formed exclusively by material drawn from the incoming supply of the foil strip material.

A lockout pin 79 is provided for keeping the hold finger 66 stationary when a new foil strip is being threaded into the machine. The lockout pin is inserted manually through a hole 68*h* in the end plate 68 and is received in a hole 66*h*2 in the hold finger. After manually inserting the end of a new strip into the machine (see the next paragraph), the machine is operated in a start mode through a few cycles to form a corrugated leader portion.in which a segment is corrugated without the hold finger being actuated. Once a few corrugations are formed in the leader along an outgoing segment of the form gear 20, so that transport of the foil strip by the form gear is established, the lockout pin can be removed and the machine started into normal operation.

Instead of coupling the hold finger 66 to the form tooth 64 and holding it against the outgoing node by the mechanical compression springs 77, as described above and shown in the drawings, the hold finger 66 may be driven by a solenoid independently of the form tooth and the linear drive of the punch unit. The operating cycle of the solenoid will, of course, be controlled to time the engagement of each outgoing node of the foil strip with the end of each indexing movement of the form gear and the beginning of each operating cycle of the punch unit. The solenoid can be inactivated when a new supply of foil strip is started into the machine.

Figure 6:
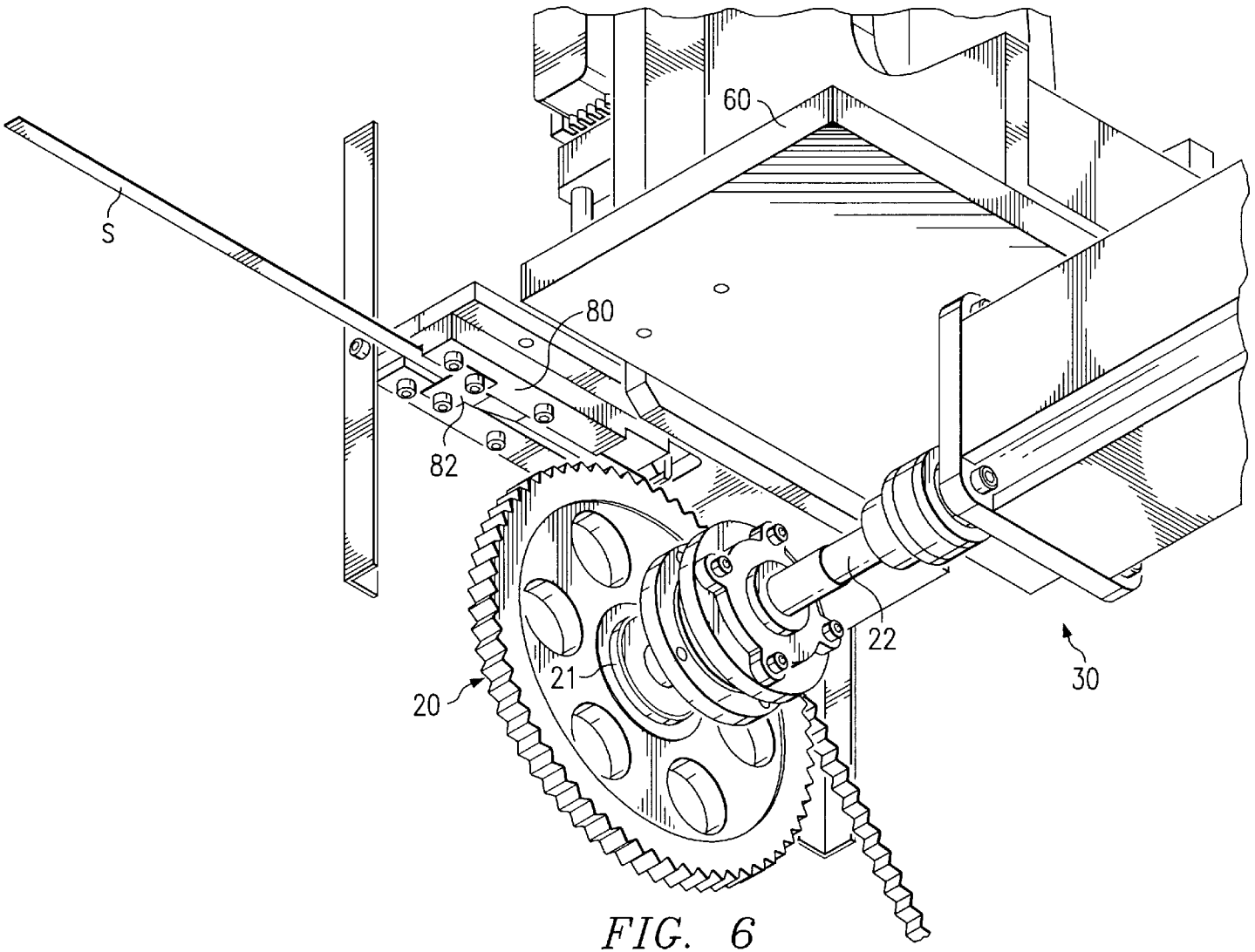
FIG. 6 is a generally schematic partial detail perspective view of the first embodiment, the view taken from a viewpoint to the rear below and to the right.

The incoming strip material S is supplied from a roll of stock by a suitable, conventional feeder F (see FIG. 8) and is guided to the form station along a slot formed between a pair of guide rails 80 affixed by machine screws to the underside of the guide mounting plate 60 (see FIG. 6) and bridged by a keeper band 82. An exit guide shoe 84 (see FIGS. 2 and 7A to 7C) that extends along a segment of the form gear immediately downstream of the forming station and has a guide surface 84*g* in close clearance with the outer nodes of an outgoing corrugated portion of the foil strip retains the outgoing portion of the corrugated foil strip in a multiplicity of cavities of the form gear. The exit guide shoe 84 holds several nodes of the corrugated foil strip immediately downstream from the forming station in place on the form gear for reliable transport of the corrugated part of the strip from the forming station and of the incoming supply strip to the forming station.

An electronic controller C controls the operation of the machine. The controller can be programmed with a relatively simple control program. Control signals are supplied to the servomotors and feedback signals are received from the servomotors 30 and 52 via power supply and amplifier modules MR and MP through cables CR and CP. It is advantageous to make one of the servomotors a master and the other a slave, thus setting up an electronic gear system in which the follower tracks the controlled speed or position of the master. The part of the computer program for the machine that controls the liner servomotor permits the operating speed (the time of each cycle), the durations of the operating and return strokes and the dwell period of each cycle, and the force applied by the form tooth to be varied. Electronic control allows high speed operation of the machine by permitting precise control of the timing of the indexing of the form gear relative to the timing of the operating cycle of the punch unit. The indexing of the form gear may begin soon after the beginning of the return stroke of the punch unit.

Figure 8:
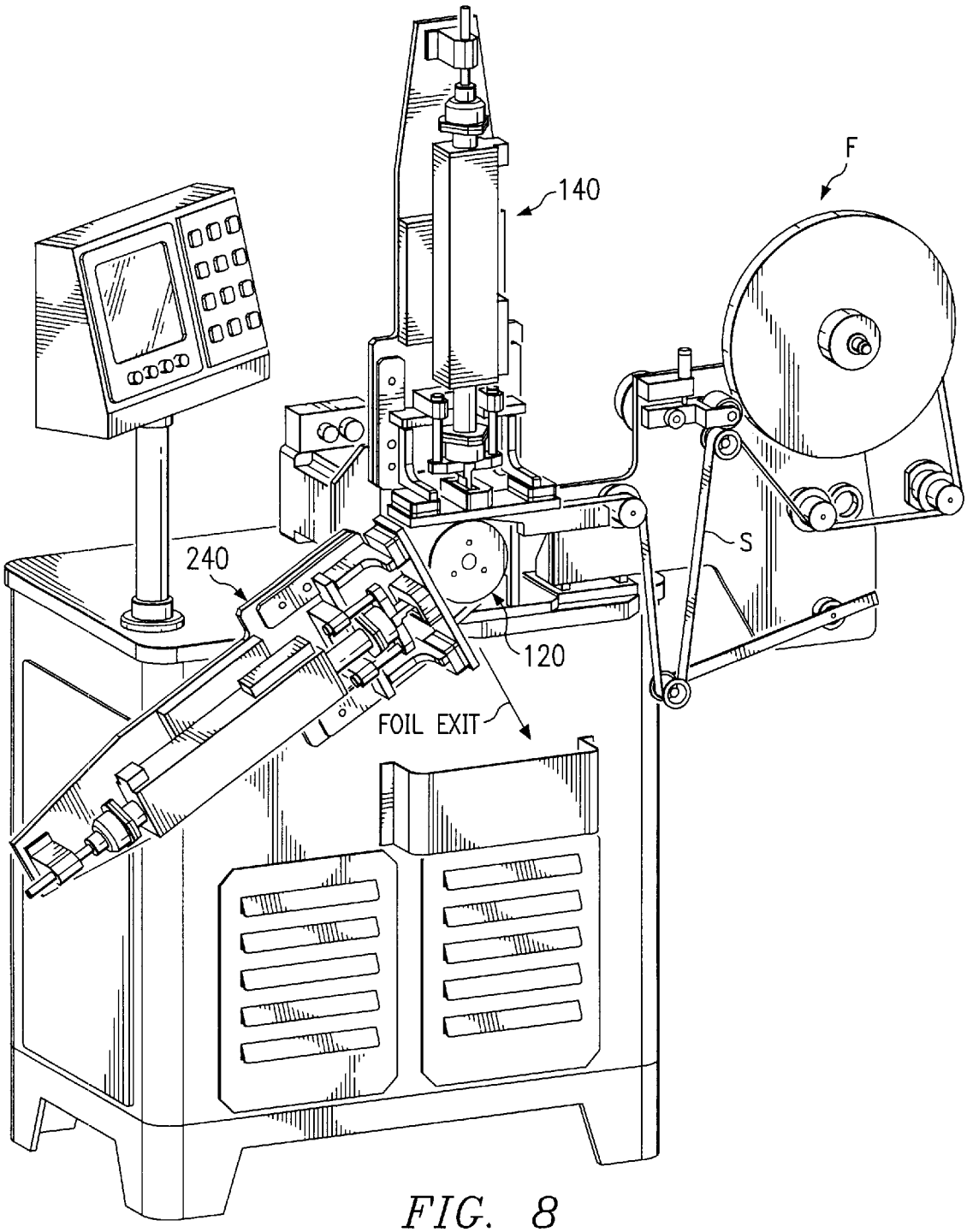
FIG. 8 is generally schematic front three-quarter perspective view of a second embodiment, which is a two-stage machine, the view being taken from a viewpoint above and to the left.
Figure 9A:
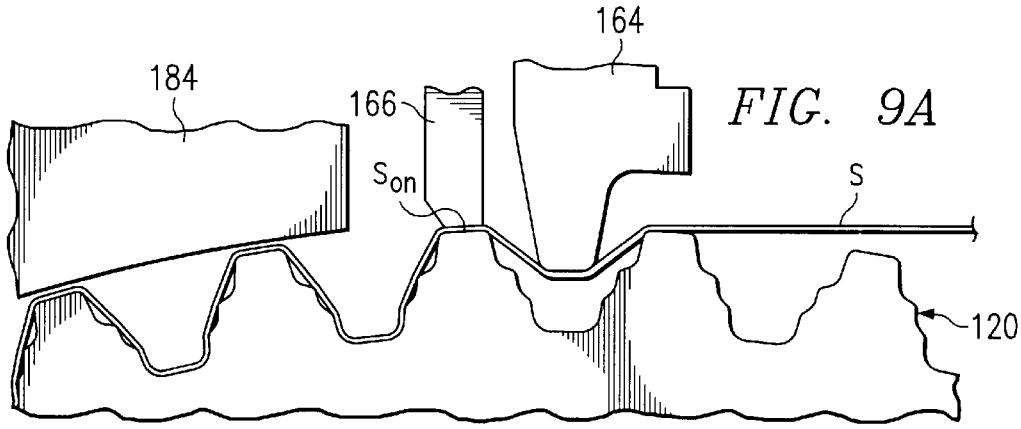
FIGS. 9A. 9B a generally schematic detail views showing two points in the operation of the forming tools of the first stage of the second embodiment.
Figure 9B:
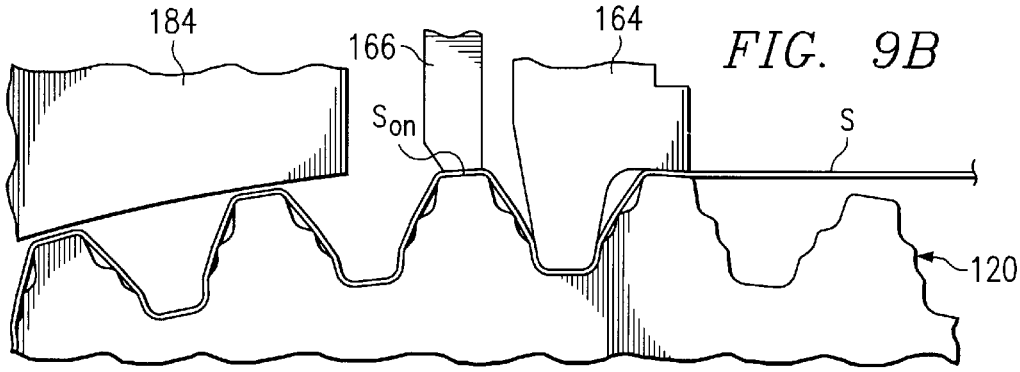
Figure 10:
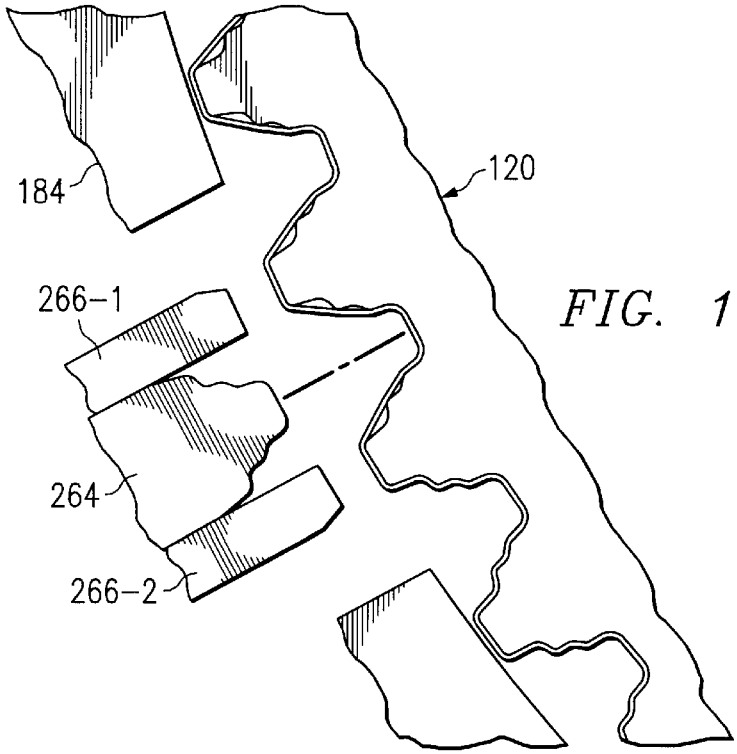
FIG. 10 is a generally schematic detail view showing the tooling of the second stage of the second embodiment.

FIG. 8 shows a two-stage machine, which is the same as the single-stage machine of FIGS. 1 to 7 except for the addition of a second-stage punch unit 240, which is located at a second forming station circumferentially downstream from a first-stage punch unit 140 located at a first forming station with respect to the counterclockwise direction of rotation (in the drawing) of the form gear 120. The first and second-stage punch units are the same as the punch unit 40 of the single-stage machine of FIGS. 1 to 7, except for the forming teeth and the hold fingers. As shown in FIGS. 9A and 9B, the form tooth 164 of the first-stage punch unit 140 is shaped to only partially form a corrugation on each forming stroke. During the forming stroke, the hold finger 166 clamps the outgoing node $S_{on}$ of the foil strips against the tooth on the outgoing side of the cavity of the form gear 120 while the form tooth 164 pushes a segment drawn from the incoming supply of foil into the cavity then at the first-stage forming station. The form gear 120 eventually indexes each partially formed corrugation from the first-stage forming station to the second-stage forming station. A guide shoe 184 holds the segment of the foil strip between the first-stage forming station and the second-stage forming station in the cavities of the form gear. The second-stage punch unit 240, as shown in FIG. 10, has a form tooth 264 that is shaped to complete each corrugation upon a forming stroke of each operating cycle of the second-stage punch unit. To ensure against pullback of part of the outgoing corrugation or pull-forward of part of the incoming corrugation immediately adjacent the corrugation then at the second forming station, the second-stage punch unit 240 has two hold fingers 266-1 and 226-2, one of which clamps the incoming node of the strip and the other of which clamps the outgoing node of the strip against the teeth of the form gear that form the cavity then at the second-stage forming station. The operating cycles of the two punch units of the two-stage machine will generally be timed identically and exactly in phase.

What is claimed is:

1. A machine for corrugating a metal foil strip, comprising a form gear having equally spaced-apart identical teeth defining a multiplicity of identical cavities along the circumference of the form gear, a rotary drive rotating the form gear intermittently to index successive cavities to a forming station along the perimeter of the form gear where a corrugation is at least partly formed in a cavity then at the forming station while the rotary drive dwells, and a punch unit located at the forming station, the punch unit having a form tooth receivable seriatim in the cavities of the form gear and adapted thereby to at least partly form corrugations in the foil strip, and a reciprocating linear actuator driving the form tooth radially of the form gear intermittently in a succession of forming cycles, each of the forming cycles including a forming stroke in which the form tooth moves into a cavity then at the forming station, a return stroke in which the form tooth moves out of the cavity then at the forming station, and a dwell period in which the form tooth dwells while the form gear indexes.

2. The machine according to claim 1, wherein the punch unit further includes a hold finger engageable with an outgoing node of a corrugation of the strip against the tip of the tooth of the form gear on the outgoing side of the cavity then at the forming station during a substantial portion of the duration of each forming stroke of the form tooth.

3. The machine according to claim 1, wherein the punch actuator includes an electronically-controlled linear servomotor.

4. The machine according to claim 3, wherein the punch unit includes a fixed tool guide having a guideway receiving a portion of the form tooth for guided axial movement.

5. The machine according to claim 4, wherein the punch unit includes a tool support affixed to the output shaft of the linear actuator and the form tooth is carried by the tool support for universal swiveling motion relative to the tool support.

6. The machine according to claim 1, wherein the rotary drive includes an electronically-controlled rotary servomotor.

7. The machine according to claim 1, wherein the rotary drive includes an electronically-controlled rotary servomotor, and the punch actuator includes an electronically-controlled linear servomotor.

8. The machine according to claim 1, wherein the rotary drive includes an electronically-controlled rotary servomotor, the punch actuator includes an electronically-controlled linear servomotor, and the drives are controlled in a master-slave relationship.

9. The machine according to claim 1, and further comprising a foil exit guide shoe extending along a segment of the form gear immediately downstream of the forming station and having a guide surface in close clearance with outer nodes of an outgoing corrugated portion of the foil strip so as to retain the outgoing corrugated portion of the foil strip in a multiplicity of cavities of the form gear.

10. The machine according to claim 1, wherein the form tooth of the punch unit is shaped to only partially form the corrugations, and further comprising a second punch unit located at a second forming station along the circumference of the form gear, the second forming station being spaced apart from the forming station, the second punch unit having a second form tooth receivable seriatim in the cavities of the form gear and shaped to fully form the corrugations in the foil strip and a second reciprocating linear actuator driving the second form tooth radially of the form gear in a succession of forming cycles, each of which includes a forming stroke in which the second form tooth moves into a cavity then at the second forming station, a return stroke in which the second form tooth moves out of the cavity then at the second forming station, and a dwell period in which the second form tooth dwells while the form gear indexes, each forming cycle of the second form tooth being in phase with the forming cycle of the form tooth of the punch unit.

11. The machine according to claim 10, wherein the second punch unit includes a pair of second hold fingers, one arranged to engage an in going node of a corrugation of the strip against the tip of the tooth of the form gear on the in going side of the cavity then at the second forming station during a substantial portion of the duration of each forming cycle of the second form tooth and the other arranged to engage an outgoing node of a corrugation of the strip against the tip of the tooth of the form gear on the outgoing side of the cavity then at the second forming station during a substantial portion of the duration of each forming cycle of the second form tooth.

12. A machine for corrugating a metal foil strip, comprising a form gear having equally spaced-apart identical teeth defining a multiplicity of identical cavities along the circumference of the form gear, an electronically-controlled rotary servomotor rotating the form gear intermittently to index successive cavities to a forming station along the perimeter of the form gear where a corrugation is at least partly formed in a cavity then at the forming station while the rotary drive dwells, and a punch unit located at the forming station, the punch unit having a form tooth receivable seriatim in the cavities of the form gear and adapted thereby to at least partly form corrugations in the foil strip, an electronically-controlled linear servomotor driving the form tooth radially of the form gear in a succession of forming cycles, each of the forming cycles including a forming stroke in which the form tooth moves into a cavity then at the forming station, a return stroke in which the form tooth moves out of the cavity then at the forming station, and a dwell period in which the form tooth dwells while the form gear indexes, and a hold finger arranged to engage an outgoing node of a corrugation of the strip against the tip of the tooth of the form gear on the outgoing side of the cavity then at the forming station during a substantial portion of the duration of each forming cycle of the form tooth.

13. The machine according to claim 12, wherein the servomotors are controlled in a master-slave relationship.

14. The machine according to claim 12, wherein the punch unit includes a fixed tool guide having a guideway receiving a portion of the form tooth for guided axial movement.

15. The machine according to claim 12, wherein the punch unit includes a fixed tool guide having a guideway receiving a portion of the hold finger for guided axial movement.

16. The machine according to claim 15, wherein the punch unit includes a tool support affixed to the output shaft of the linear actuator and the form tooth is carried by the tool support for universal swiveling motion relative to the tool support.

17. A machine for corrugating a metal foil strip, comprising a form gear having equally spaced-apart identical teeth defining a multiplicity of identical cavities along the circumference of the form gear, an electronically-controlled rotary servomotor rotating the form gear intermittently to index successive cavities to first and second forming stations along the perimeter of the form gear where corrugations are formed in the cavities while the rotary drive dwells, and a punch unit located at each of the forming stations, each punch unit having a form tooth receivable seriatim in the cavities of the form gear and adapted thereby to at least partly form corrugations in the foil strip, an electronically-controlled linear servomotor driving the form tooth radially of the form gear in a succession of forming cycles, each of the forming cycles including a forming stroke in which the form tooth moves into a cavity then at the forming station, a return stroke in which the form tooth moves out of the cavity then at the forming station, and a dwell period in which the form tooth dwells while the form gear indexes, and a hold finger arranged to engage an outgoing node of a corrugation of the strip against the tip of the tooth of the form gear on the outgoing side of the cavity then at the forming station during a substantial portion of the duration of each forming cycle of the forming unit.

18. The machine according to claim 17, wherein the servomotors are controlled in a master-slave relationship.

19. The machine according to claim 17, wherein each punch unit includes a fixed tool guide having a guideway receiving a portion of the form tooth for guided axial movement.

20. The machine according to claim 19, wherein the punch unit includes a fixed tool guide having a guideway receiving a portion of the hold finger for guided axial movement.

21. The machine according to claim 20, wherein each punch unit includes a tool support affixed to the output shaft of the linear actuator and the form tooth is carried by the tool support for universal swiveling motion relative to the tool support.

22. The machine according to claim 17, wherein the punch unit at the second forming station has a hold finger arranged to engage an incoming node of a corrugation of the strip against the tip of the tooth of the form gear on the incoming side of the cavity then at the second forming station during a substantial portion of the duration of each forming cycle of the second punch unit.

* * * * *